US008631875B2

(12) United States Patent
Nguyen et al.

(10) Patent No.: US 8,631,875 B2
(45) Date of Patent: Jan. 21, 2014

(54) INSERT GAS LIFT INJECTION ASSEMBLY FOR RETROFITTING STRING FOR ALTERNATIVE INJECTION LOCATION

(75) Inventors: Hai H. Nguyen, Houston, TX (US); James H. Holt, Willis, TX (US); James H. Kriztler, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 296 days.

(21) Appl. No.: 13/154,642

(22) Filed: Jun. 7, 2011

(65) Prior Publication Data

US 2012/0312554 A1 Dec. 13, 2012

(51) Int. Cl.
*E21B 43/00* (2006.01)

(52) U.S. Cl.
USPC ..... 166/372

(58) Field of Classification Search
USPC ..... 166/372
See application file for complete search history.

(56) References Cited

U.S. PATENT DOCUMENTS

| | | | | |
|---|---|---|---|---|
| 12,143 | A | 1/1855 | Tucker | |
| 2,416,842 | A | 3/1947 | O'Leary | |
| 4,022,273 | A | 5/1977 | Marathe | |
| 4,387,767 | A | 6/1983 | Read | |
| 4,490,095 | A | 12/1984 | Soderberg | |
| 4,545,731 | A | 10/1985 | Canalizo et al. | |
| 4,589,482 | A | 5/1986 | Bayh, III | |
| 4,616,981 | A | 10/1986 | Simmons et al. | |
| 4,632,184 | A | 12/1986 | Renfroe et al. | |
| 4,646,827 | A | 3/1987 | Cobb | |
| 5,092,400 | A | 3/1992 | Jagert | |
| 5,148,865 | A | 9/1992 | Reed | |
| 5,203,409 | A | 4/1993 | Seid et al. | |
| 5,522,464 | A | 6/1996 | Piper | |
| 5,662,169 | A | 9/1997 | Hosie | |
| 5,727,631 | A | 3/1998 | Baker et al. | |
| 5,862,865 | A | 1/1999 | Murray et al. | |
| 5,896,924 | A | 4/1999 | Carmody et al. | |
| 5,915,475 | A | 6/1999 | Wells et al. | |
| 6,026,904 | A * | 2/2000 | Burd et al. | 166/372 |
| 6,467,541 | B1 | 10/2002 | Wells | |
| 6,688,386 | B2 | 2/2004 | Cornelssen et al. | |
| 6,715,554 | B1 | 4/2004 | Cunningham et al. | |
| 6,810,955 | B2 | 11/2004 | Roth et al. | |
| 6,851,478 | B2 | 2/2005 | Cornelssen et al. | |

(Continued)

FOREIGN PATENT DOCUMENTS

| | | |
|---|---|---|
| CA | 2310236 | 12/2001 |
| CA | 2497090 | 8/2006 |

(Continued)

*Primary Examiner* — William P Neuder
(74) *Attorney, Agent, or Firm* — Steve Rosenblatt

(57) ABSTRACT

An insert device can straddle an existing production string port into the annulus such as through an open sliding sleeve so that annulus access into the production string is available. An injection string is associated with the insert to allow placement of the injection fluid at the desired location even if that location is below an isolation packer. The port can be part of an existing ported sub such as a sliding sleeve. Alternatively, the port can be created at a desired location and the insert supported with an anchor so that spaced seals straddle the port that is created to allow injection access from the annulus into the production tubing. The produced fluids pass around the injection tubing and through the insert body to get to the surface. The insert can be removed if needed.

19 Claims, 2 Drawing Sheets

(56) References Cited

U.S. PATENT DOCUMENTS

| | | | | |
|---|---|---|---|---|
| 7,025,132 | B2 | 4/2006 | Kent et al. | |
| 7,228,897 | B2 | 6/2007 | Holt, Jr. et al. | |
| 7,325,600 | B2 | 2/2008 | Sieben | |
| 7,360,602 | B2 | 4/2008 | Kritzler et al. | |
| 7,367,401 | B2 * | 5/2008 | Moffett et al. | 166/372 |
| 7,588,086 | B2 * | 9/2009 | Moffett et al. | 166/372 |
| 7,637,326 | B2 | 12/2009 | Bolding et al. | |
| 7,699,099 | B2 | 4/2010 | Bolding et al. | |
| 7,712,537 | B2 | 5/2010 | Hill et al. | |
| 7,770,637 | B2 | 8/2010 | Phoi-montri et al. | |
| 7,823,648 | B2 | 11/2010 | Bolding et al. | |
| 7,886,830 | B2 | 2/2011 | Bolding et al. | |
| 7,954,551 | B2 | 6/2011 | Bolding | |
| 2002/0000315 | A1 | 1/2002 | Kent et al. | |
| 2002/0134548 | A1 | 9/2002 | Lam et al. | |
| 2003/0056958 | A1 | 3/2003 | Allan | |
| 2004/0112604 | A1 | 6/2004 | Milberger et al. | |
| 2004/0154790 | A1 | 8/2004 | Cornelssen et al. | |
| 2004/0262010 | A1 | 12/2004 | Milberger | |
| 2005/0022998 | A1 | 2/2005 | Rogers, Jr. | |
| 2005/0175476 | A1 | 8/2005 | Patterson | |
| 2005/0249613 | A1 | 11/2005 | Jordan et al. | |
| 2006/0008364 | A1 | 1/2006 | Traylor | |
| 2008/0029271 | A1 | 2/2008 | Bolding et al. | |

FOREIGN PATENT DOCUMENTS

| | | |
|---|---|---|
| EP | 0637675 | 2/1995 |
| GB | 2377954 | 1/2003 |
| WO | 9904137 | 1/1999 |

* cited by examiner

INSERT GAS LIFT INJECTION ASSEMBLY FOR RETROFITTING STRING FOR ALTERNATIVE INJECTION LOCATION

FIELD OF THE INVENTION

The field of the invention is gas lift systems where injection needs to occur in an existing system where there is no side pocket mandrel and more particularly for an insert device that allows annulus pressure to be introduced at a predetermined depth through an existing or produced tubing opening to inject fluid, defined as a liquid, a gas or combinations thereof, at the desired location and if needed past an isolation packer for the zone in question.

BACKGROUND OF THE INVENTION

Gas lift is a technique where fluid is injected in the tubing string from the surrounding annulus to reduce the density of the produced fluids and in turn allow the formation pressure to lift the less dense mixture to the surface. To accomplish this a series of valves that allow access from the annulus into the production tubing are used. These valves are inserted in side pocket mandrels so that a clear production string is available for running in or removing tools using the production string. The predetermined position of the gas lift valves controls the entry points for gas into the production string.

As the well produces the operating conditions can change and call for gas lift at a new location that is generally deeper or further from the surface than the location of the existing gas lift valves. The new location needed for gas lift can also be below an existing isolation packer. What is needed and provided is a retrofit way of getting access and an injection location at a new desired location without pulling the production string to reconfigure the location of the annulus access locations. This can be done by either employing exiting wall ports in the tubing string regardless of their location such as sliding sleeves. The insert is installed and latched to straddle the tubing string wall port so that annulus pressure can be directed through the insert into tubing supported from the insert so the precise desired location for the admission of the injection gas can be obtained. The produced fluids come to the surface around the injection tubing and bypass the inlet piping from the annulus into the injection tubing. Alternatively, a port can be produced at a desired location in the production string and an insert straddle tool can be located on an anchor to straddle the new opening. The insert can have tubing so that the injection point can be predetermined. The insert can be removed and in the case of a sliding sleeve valve as the access location, the sliding sleeve can then be closed. Those and other aspects of the present invention can be more readily appreciated from a review of the description of the preferred embodiment and the associated drawings while appreciating that the full scope of the invention is to be determined from the appended claims.

The following references discuss gas lift systems and show side pocket mandrels that are used to house valves for access from the annulus at predetermined locations into the production tubing: U.S. Pat. Nos. 7,360,602; 7,228,897 (shows cementing through side pocket mandrels); U.S. Pat. Nos. 6,810,955; 5,862,865 (shows insert safety valves for a retrofit for gas lift using existing control lines) and U.S. Pat. No. 5,896,924 (shows computer control of gas lift valves).

SUMMARY OF THE INVENTION

An insert device can straddle an existing production string port into the annulus such as through an open sliding sleeve so that annulus access into the production string is available. An injection string is associated with the insert to allow placement of the injection fluid at the desired location even if that location is below an isolation packer. The port can be part of an existing ported sub such as a sliding sleeve. Alternatively, the port can be created at a desired location and the insert supported with an anchor so that spaced seals straddle the port that is created to allow injection access from the annulus into the production tubing. The produced fluids pass around the injection tubing and through the insert body to get to the surface. The insert can be removed if needed.

DETAILED DESCRIPTION OF THE PREFERRED EMBODIMENT

Figure 1:
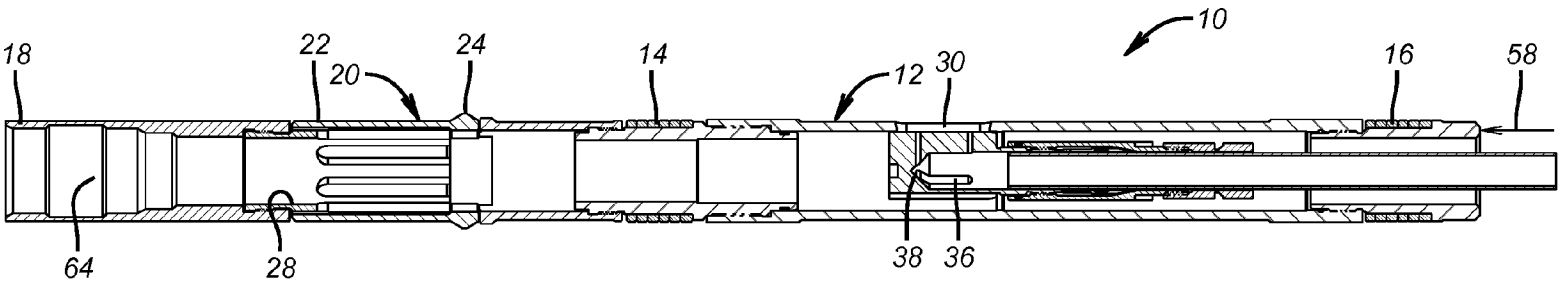
FIG. 1 is a section view of the insert assembly of the present invention.
Figure 2:
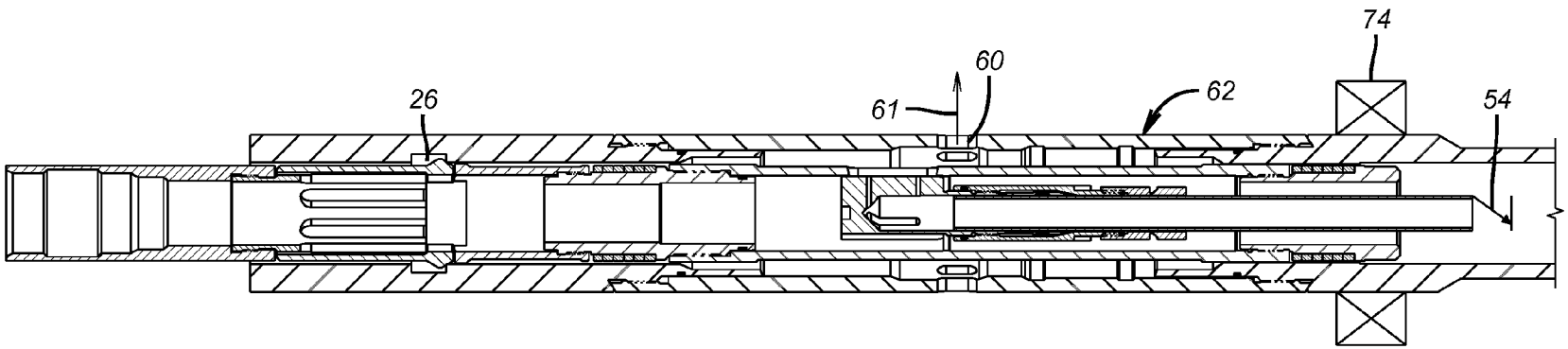
FIG. 2 is the view of FIG. 1 with the insert installed straddling an opening in the production tubing.
Figure 3:
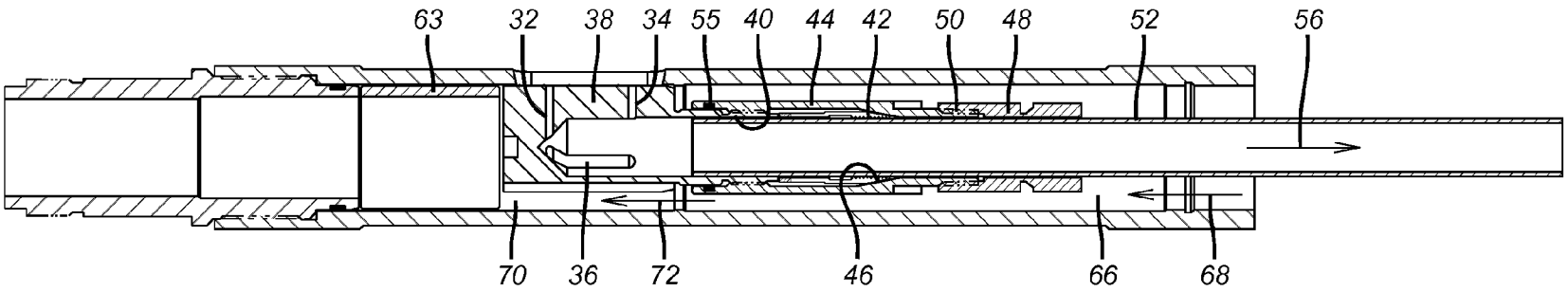
FIG. 3 is an enlarged view of the lower end of the insert shown in FIG. 2.

The insert 10 has a multi-component mandrel 12 with spaced external seals 14 and 16. Near the upper end 18 there can be a latch assembly 20 such as a model M/F Lock offered by Baker Hughes which comprises a series of flexible collet fingers 22 with heads 24 that are meant to spring into a profile such as 26 shown in FIG. 2. A sleeve 28 is shifted to support the heads 24 in the profile 26. In between seals 14 and 16 is inlet opening 30 that leads to passages 32 and 34 that lead to internal passage 36 in hub 38. Hub 38 has a series of extending fingers 40 that have tapered end segments with external gripping profiles 42 that are in turn surrounded by housing 44 that has an internal taper 46. A jam nut 48 is attached to the housing 44 at thread 50. The tightening of the jam nut 48 secures the injection tubing 52 against the hub 38. Various seals such as 55 insure that the abutting connection of the tubing 52 against the hub 38 is fluid tight. In essence, tightening the jam nut 48 crimps the tubing 52 by advancing the tapered surface 46 over the gripping profiles 42 to push the gripping profiles 42 into the outside wall of the injection tubing 52. A check valve 54 that only allows flow in the direction of arrow 56 can be installed in the tubing 52. As an option, instead of the latch assembly 20, an anchor, schematically illustrated as arrow 58 can be used to position the insert 10 about a port 60 in the production string 62.

If the insert 10 is to be positioned adjacent an existing port such as 60 that can be associated with a sliding sleeve 63, there will be an available profile 26 near the sleeve so that a shifting tool can latch there and move the sleeve between open and closed positions. However, if the port 60 has to be created, such as with a wedge driven penetration tool schematically illustrated by arrow 61 then the insert 10 will need to be provided with an anchor such as schematically represented by arrow 58 to maintain the seals 14 and 16 in relative position with respect to the opening 60 so that the flow between ports 60 on the string 62 and 30 on the insert 10 can be sealed from tubing passage 64. Produced fluids go toward the surface around the injection tubing 52 through annular passage 66 as represented by arrow 68 and reach the passage 64 by going through an opening or openings 70 in hub 38 as represented by arrow 72.

A packer 74 is schematically illustrated on the production tubing 62 to show that the injection tubing can extend into the production tubing 62 well below the packer 74 using a desired length of the injection tubing 52.

The latch assembly 20 can be released so that the insert assembly 10 can be removed and the port or ports 60 can be closed such as with a sliding sleeve.

Various alternative designs are envisioned. The injection string 52 can be sealingly supported to the hub 38 in a variety of ways. The desired length of the string 52 is determined at the surface and the connection to the hub 38 is also made at the surface. The insert assembly 10 can be admitted into a live well through a lubricator (not shown) by first introducing the injection tubing 52 and then lowering the insert assembly 10 on a slickline, wireline or coiled tubing (not shown).

The present invention allows retrofit of an existing well that has side pocket mandrels at locations that are no longer optimum for continued production to again be optimized for enhanced production by locating injection at the desired location. This can be done by deploying existing production tubing wall openings such as sliding sleeve valves or circulation subs or by making a hole at any convenient location that can then be straddled with the insert assembly 10 with injection tubing hanging from the assembly 10 providing even more flexibility as to the injection location. It should be noted that the use of the injection string is optional such as when the injection location and the location of the existing or added wall port 60 in the production tubing 62 is already at the desired location. One or more check valves 54 can be employed to keep production fluid from getting to the annulus through the hub 38. Although normally it will not be required there is also a possibility for using more than a single insert assembly 10 with an associated injection tubing 52 in the production string 62 at a given time to allow the addition of more than a single injection location into an existing production string 62. As another option the insert assemblies can be fitted to a production string as it is being run into the wellbore as opposed to installing the insert assemblies 10 when the string 62 is already in position. In some instances when using the insert assemblies 10 when running in the production string 62 the use of side pocket mandrels can be minimized or eliminated.

The above description is illustrative of the preferred embodiment and many modifications may be made by those skilled in the art without departing from the invention whose scope is to be determined from the literal and equivalent scope of the claims below.

We claim:

1. A method for adding at least one fluid injection location to a production string, comprising:

providing at least one port in the production string for fluid communication to a surrounding annulus when said production string is at a subterranean location or before said production string is run to a desired subterranean location;

straddling said port with an injection assembly;

directing annulus fluid through said port and through an injection passage in said injection assembly into a flow path in said production string;

producing through said flow path in said production string;

providing a valve in said injection assembly.

2. The method of claim 1, comprising:

using a tool to penetrate a wall in said production string to provide said port when said production string is located at a desired subterranean location.

3. The method of claim 1, comprising:

extending said passage in said injection assembly with an injection string extending into said flow path in said production string.

4. The method of claim 3, comprising:

providing an isolation packer on said production string;

providing a length of said injection string that extends through said flow path in said production string and past said isolation packer.

5. The method of claim 3, comprising:

allowing injected and produced fluid to flow in an annular space between said injection string and said production string.

6. The method of claim 3, comprising:

providing spaced external seals in said injection assembly;

straddling said port in said production string with said seals.

7. The method of claim 1, comprising:

providing spaced external seals in said injection assembly;

straddling said port in said production string with said seals.

8. The method of claim 1, comprising:

providing a sliding sleeve with an adjacent profile as said valve in said port;

supporting said injection assembly from said profile.

9. The method of claim 8, comprising:

providing a lock assembly on said injection assembly for selective locking to said profile;

using a flexible collet in said lock assembly that is selectively supported with a shifting sleeve to anchor said injection assembly to said production string.

10. The method of claim 1, comprising:

removing said injection assembly after said producing.

11. A method for adding at least one fluid injection location to a production string, comprising:

providing at least one port in the production string for fluid communication to a surrounding annulus when said production string is at a subterranean location or before said production string is run to a desired subterranean location;

straddling said port with an injection assembly;

directing annulus fluid through said port and through an injection passage in said injection assembly into a flow path in said production string;

producing through said flow path in said production string;

providing an anchor on said injection assembly;

using said anchor to support said injection assembly when said port is straddled against movement in opposed directions.

12. The method of claim 11, comprising:

providing spaced external seals in said injection assembly;

straddling said port in said production string with said seals.

13. A method for adding at least one fluid injection location to a production string, comprising:

providing at least one port in the production string for fluid communication to a surrounding annulus when said production string is at a subterranean location or before said production string is run to a desired subterranean location;

straddling said port with an injection assembly;

directing annulus fluid through said port and through an injection passage in said injection assembly into a flow path in said production string;

producing through said flow path in said production string;

extending said passage in said injection assembly with an injection string extending into said flow path in said production string;

locating said passage in said injection assembly in a hub;

joining said injection string to said hub.

14. The method of claim 13, comprising:

sealing said injection string to said hub;

crimping a hub supported slip into said injection string to fixate said injection string to said hub.

15. The method of claim 14, comprising:

actuating said slip toward said injection string with a jam nut assembly.

16. A method for adding at least one fluid injection location to a production string, comprising:

providing at least one port in the production string for fluid communication to a surrounding annulus when said production string is at a subterranean location or before said production string is run to a desired subterranean location;

straddling said port with an injection assembly;

directing annulus fluid through said port and through an injection passage in said injection assembly into a flow path in said production string;

producing through said flow path in said production string; extending said passage in said injection assembly with an injection string extending into said flow path in said production string;

allowing injected and produced fluid to flow in an annular space between said injection string and said production string;

providing a bypass passage in said injection assembly to direct injected and produced fluid past said injection assembly on the way to the surface;

isolating said bypass passage from said injection passage in said injection assembly.

17. A method for adding at least one fluid injection location to a production string, comprising:

providing at least one port in the production string for fluid communication to a surrounding annulus when said production string is at a subterranean location or before said production string is run to a desired subterranean location;

straddling said port with an injection assembly;

directing annulus fluid through said port and through an injection passage in said injection assembly into a flow path in said production string;

producing through said flow path in said production string; extending said passage in said injection assembly with an injection string extending into said flow path in said production string;

providing spaced external seals in said injection assembly;

straddling said port in said production string with said seals;

providing a sliding sleeve with an adjacent profile as said valve in said port;

supporting said injection assembly from said profile.

18. The method of claim 17, comprising:

providing a lock assembly on said injection assembly for selective locking to said profile;

using a flexible collet in said lock assembly that is selectively supported with a shifting sleeve to anchor said injection assembly to said production string.

19. The method of claim 18, comprising:

providing an isolation packer on said production string;

providing a length of said injection string that extends through said flow path in said production string and past said isolation packer.

* * * * *